United States Patent [19]

Endo

[11] Patent Number: 4,692,047

[45] Date of Patent: Sep. 8, 1987

[54] BRUSH FOR APPLYING MATERIAL IN LIQUID OR EMULSION FORM

[76] Inventor: Sasuke Endo, 802, Hiroo Nashonaru Koto, 10-32, Minami Azabu 5-Chome, Minato-Ku, Tokyo-To, Japan

[21] Appl. No.: 754,835

[22] Filed: Jul. 12, 1985

Related U.S. Application Data

[63] Continuation-in-part of Ser. No. 601,850, Apr. 19, 1984.

[30] Foreign Application Priority Data

| | | | |
|---|---|---|---|
| Apr. 20, 1983 | [JP] | Japan | 58-68450 |
| Aug. 15, 1983 | [JP] | Japan | 58-148137 |
| Feb. 8, 1984 | [JP] | Japan | 59-16570 |
| Feb. 8, 1985 | [JP] | Japan | 60-22042 |
| Apr. 30, 1985 | [JP] | Japan | 60-92877 |

[51] Int. Cl.[4] ..... B43K 5/02; B43K 7/10

[52] U.S. Cl. ..... 401/141

[58] Field of Search ..... 401/141, 151, 150, 176, 401/186, 286, 287

[56] References Cited

U.S. PATENT DOCUMENTS

| | | | |
|---|---|---|---|
| 2,308,078 | 1/1943 | Hendrickson | 222/387 |
| 2,737,329 | 3/1956 | Bosley | 401/141 |
| 2,743,042 | 4/1956 | Burgin | 222/191 |
| 3,261,367 | 7/1966 | Pickering | 401/135 |
| 3,400,996 | 9/1968 | Vandergrift | 401/184 |
| 3,613,698 | 10/1971 | Fox | 401/176 |
| 3,854,826 | 12/1976 | Adams | 401/141 |
| 3,937,235 | 2/1976 | Broughton | 132/84 B |

FOREIGN PATENT DOCUMENTS

| | | | |
|---|---|---|---|
| 2630569 | 1/1978 | Fed. Rep. of Germany . | |
| 929420 | 12/1949 | France . | |
| 2222050 | 10/1974 | France | 401/176 |
| 2357204 | 2/1978 | France . | |

*Primary Examiner*—Robert Peshock

*Attorney, Agent, or Firm*—Wenderoth, Lind & Ponack

[57] ABSTRACT

A brush for applying liquid or emulsion material such as toothpaste, hair-dye, cleaning material, etc., has a handle, a rod having bristles, sponge, etc. at its head and a pumping mechanism accommodated in the handle. The rod is slidably held, at its rear end, by the main body of the handle. When the rod is pushed rearward and thereafter released, the pumping mechanism is operated so as to such the material from a container forming a part of the handle and feed the sucked material to the head of the rod.

15 Claims, 20 Drawing Figures

BRUSH FOR APPLYING MATERIAL IN LIQUID OR EMULSION FORM

This is a continuation-in-part of application Ser. No. 601,850, filed Apr. 19, 1984.

BACKGROUND OF THE INVENTION

This invention relates to a brush for applying liquid or emulsion material, having a container for containing material such as tooth-brushing material, hair-dye, hair-growth material, hair-dressing material, paints, cleaning material, lubricating oil, etc. in liquid or emulsion form.

There have been proposed various brushes for applying liquid or emulsion material. For example, there have appeared toothbrushes which contain therein tooth-brushing material in paste or emulsion form and feed the material onto their bristle-planted portions when they are used for tooth-brushing operations. In those tooth-brushes disclosed in Japanese Utility Model Publication Nos. 138966/1977 and 102374/1979, the material contained in their handles is extruded by extrusion members, such as a piston, or others. However, the operation for extruding the material is troublesome, and it is difficult to adjust the piston or others so as to extrude a necessary amount of the material. In a toothbrush of the type which contains a tooth-brushing material extrusion mechanism in its handle, much space is not allowed for the material. If the toothbrush is made disposable, the material runs out before its bristle-planted portion becomes unusable, and it is inevitable to make the material refillable. Additionally the sealing is not carried out perfectly between the interior of its handle and the bristle-planted portion. Accordingly there has been a case wherein the material flows back into the interior of the handle from its user's mouth during the tooth-brushing operation. As described above, the conventional toothbrushes containing tooth-brushing material have these various drawbacks.

Further, as a brush for dyeing hair, there have appeared brushes of a type having a handle on the fore part of which a great number of bristles are held so as to be extended in the radial direction from the fore part thereof. When a user uses the brush to dye his hair, he pours hair-dye on the bristles from a bottle containing the hair-dye to apply the hair-dye on his hair while rubbing his hair with the brush.

In this dyeing operation, it is troublesome for the user to pour a predetermined amount of hair-dye on the bristles of the brush. Sometimes he pours hair-dye more or less than a necessary amount on its bristles thereby causing an uneven dyeing.

Moreover, when a user applies hair-growth medical liquid or hair-dressing medical liquid on his hair or his head skin, he pours an amount of the medical liquid onto his palm from a bottle containing it to rub it on his hair with his palm or he pours an amount of the medical liquid on his hair directly from the bottle to rub it on his hair with his hand. In this applying operation, the user's hand becomes dirty.

SUMMARY OF THE INVENTION

It is an object of this invention to provide a brush for applying liquid or emulsion material such as toothpaste, hair-dye, etc., containing therein the material in liquid or emulsion form, which is simple in structure and can be operated by one hand to feed a necessary quantity of the material onto its bristle-planted or sponge-applied surface.

According to this invention, there is provided a brush for applying liquid or emulsion material, comprising: a handle having a container for containing material in liquid or emulsion form and a main body, a rear end of which is connected detachably to a mouth of the container; a bristle-planted or sponge-applied rod provided, at its head, with a great number of bristles or a sponge, inserted, at its root portion, axially slidably into a forward bearing portion of the main body in such a manner that rotation of the rod can be avoided by a rotation-preventing-means, and having a material feeding passage extending from its root portion to a bristle planted or sponge applied surface of the head of the rod; and a pumping mechanism provided in the main body for sucking the material from the container and feeding the sucked material to the bristle-planted or sponge applied surface, and operated in accordance with axial movements of the rod at the time when the rod is pushed rearward and thereafter returned forward.

The nature, utility, and further features of this invention will be more clearly apparent from the following detailed description with respect to preferred embodiments of the invention when read in conjunction with the accompanying drawings briefly described below.

DETAILED DESCRIPTION OF THE INVENTION

Figure 1:
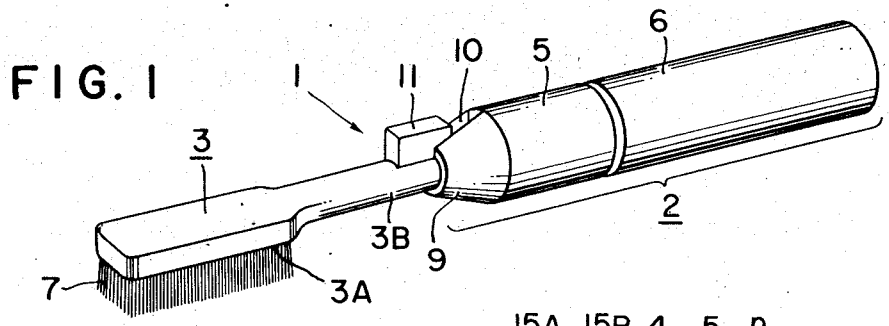
FIG. 1 is a perspective view of a first embodiment of a brush of this invention.
Figure 2:
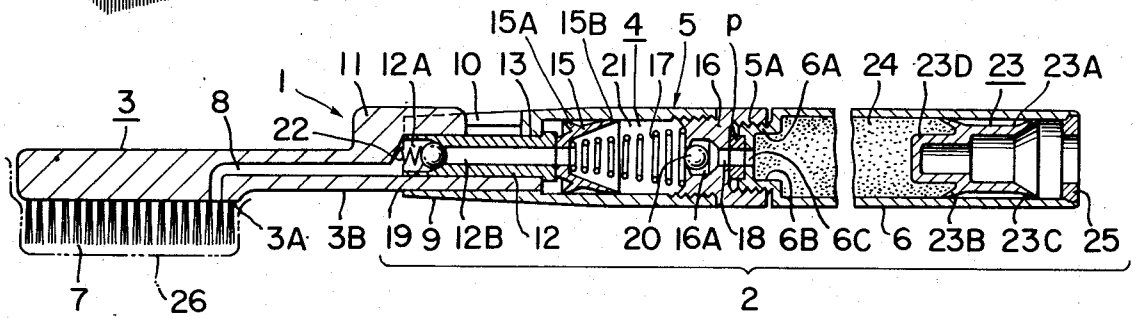
FIG. 2 is a vertical sectional view of a first embodiment of the brush of this invention.

In FIGS. 1 and 2, a brush 1 of this invention comprises a handle 2 and a bristle-planted rod 3 inserted in the forward end of the handle 2 slidably axially thereof, the handle 2 housing a pumping mechanism 4 for feeding material such as tooth-brushing material, hair-dye, hair-growth material, hair-dressing material, cleaning material, paints, lubricating oil, etc. in liquid or emulsion form.

The handle 2 comprises a combination of a main body 5 and a material container 6 for housing a liquid or emulsion material 24, connected to the handle body 5. The container 6 has a male thread 6A provided in the projected peripheral surface of the forward end thereof, and the body 5 has a female thread 5A provided in the inside peripheral surface of the rear portion thereof. The body 5 and the container 6 are connected detachably to each other by the screw-engagement of the male thread 6A with the female thread 5A.

The bristle-planted rod 3 is formed with brush means at its head for application of the material, in a flat shape of rectangular section like a common brush. The bristles 7 are planted in a bristle-planted surface 3A of the head of the rod 3. The rod 3 has a material passage 8 provided in the interior thereof from the rear end or root portion 3B to the bristle-planting surface 3A thereof. The passage 8 opens directly on the bristle-planting surface 3A or is in communication with the planting holes of the respective bristles 7 planted in the bristle-planted surface 3A so that the material 24 can be exuded at the roots of the bristles 7.

The rod 3 is slidably inserted at the root portion 3B thereof into the bearing portion 9 of the body 5 so as to keep a sealing function between the root portion 3B and the inside peripheral surface of the bearing portion 9. The bearing portion 9 has a slit 10 extending axially in the peripheral surface of the bearing portion 9. An operational projection 11 is protruded from the outside peripheral surface of the root portion 3B of the rod 3. The projection 11 is engaged slidably with the slit 10 to prevent the rod 3 from rotating about its axis.

The pumping mechanism 4 has an operational pipe 12 which is slidably inserted, at its forward portion, into the root portion 3B of the rod 3. The operational pipe 12 is inserted, at its rear portion, in a bearing hole 13 formed in the bottom of the bearing portion 9 of the body 5. The mechanism 4 has further a valve portion 15 formed in a bell-shape at the rear end of the operational pipe 12. The valve portion 15 is slidably disposed in the body 5 in a close contact with the inside peripheral surface thereof, and a compression spring 17 for returning the rod 3 via the operational pipe 12 in their forward direction, interposed between the rear end of the operational pipe 12 and a valve seat member 16 screwed on the rear end of the body 5.

The valve portion 15 has two lip portions 15A and 15B at the front and rear ends, respectively. The front lip portion 15A functions to prevent air and dirty water from entering and permeating into the main body 5 through the sliding portions of the bearing portion 9 while the rear lip portion 15B functions to prevent the material from leaking out.

A forward valve body 19 and a rear valve body 20 both in the shape of a ball are disposed respectively in a larger-diameter portion 12A formed at the outer end of the operational rod 12 and at a larger-diameter portion 16A formed at the forward end of a suction hole 18 passing through the valve seat member 16. The forward valve body 19 disposed in the operational pipe 12 opens and closes the outer end of a conduit 12B in the pipe 12 thereby to communicate and uncommunicate the same with the passage 8. The forward valve body 19 is always urged rearward by a spring 22. The rear valve body 20 disposed in the valve seat member 16 opens and closes the suction hole 18 of the valve seat member 16. An airtight suction chamber 21 is thus defined in the main body 5. In the rear portion of the valve seat member 16 is provided a packing or seal P for keeping an airtight contact between the front end of the container 6 and the rear end of the valve seat member 16.

The material container 6 is joined to the main body 5 by engaging the male thread 6A with the female thread 5A in the valve seat member 16 with the packing P compressed between the forward end of the container 6 and the end face of the valve seat member 16. This joint brings the suction hole 18 of the valve seat member 16 into communication with the opening 6C of the container 6. The container 6 is provided with a bottom having a piston-like movable bottom body 23 which is slidable axially in close contact with the inside peripheral surface of the container 6. The movable bottom body 23 is made of soft synthetic resin or other material and has slide edges 23B and 23C which are expanded in a bell-shape respectively at the forward end and the rear end of a cylindrical portion 23A. The tight contact of the slide edges 23B and 23C with the inside peripheral wall of the container 6 ensures the airtightness so that an emulsified material or liquid material 24 filled in the container 6 may not leak therefrom.

At the forward end of the cylindrical portion 23A, there is provided a smaller-diameter cylindrical portion 23D which can be inserted in the projected smaller-diameter portion 6B of the mouth of the container 6 so that all material 24 can be completely consumed. In drawings reference numeral 25 indicates a ring for preventing the movable bottom body 23 from dropping off from the rear end of the container 6. The ring 25 is inserted into the peripheral surface of the opened rear end of the container 6. At the same time, the ring 25 functions as a reinforcement member for preventing the deformation of the container by outside forces in order to keep the close contact of the slide edges 23B and 23C with the inside of the container 6.

The operation of the brush 1 will be explained with reference to FIGS. 2 to 6.

Figure 3:
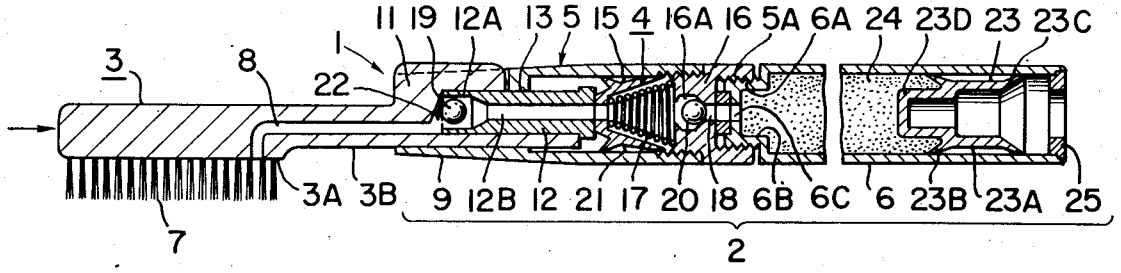
FIG. 3 is a vertical sectional view of the brush of a first embodiment in the condition where a bristle-planted rod is pushed into a handle main body.

The handle 2 is held in one hand in the state shown in FIG. 2. When the brush 1 is used, the bristle-planted rod 3 is pushed rearward or toward the container 6 by putting a thumb on the operational projection 11, by pushing the tip of the rod 3 with the other hand, or by pressing the tip of the rod 3 against something. The rear portion of the rod 3 is pushed into the handle 2 along the bearing portion 9 as shown in FIG. 3 with the operational pipe 12 being pushed to rearwardly in the handle main body 5. At this time, the forward valve body 19 opens the conduit 12B and the rear valve body 20 closes the suction hole 18.

Figure 4:
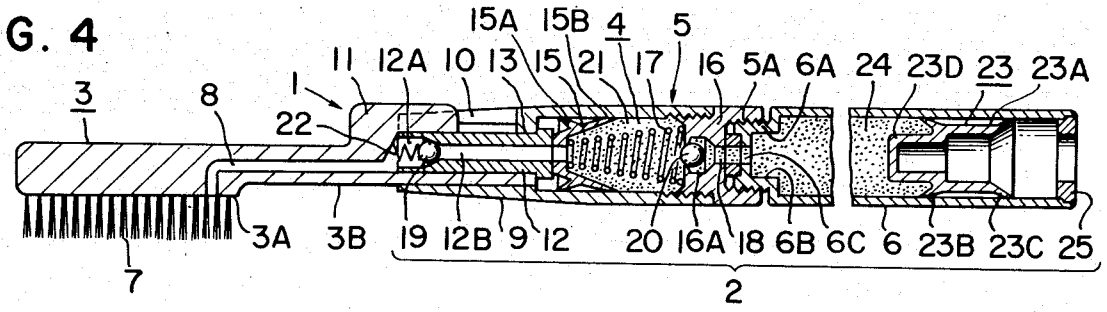
FIG. 4 is a vertical sectional view of the brush of a first embodiment in the condition where the bristle-planted rod is returned after being pushed thereinto initially.

Then the rod 3 is freed from the push so as to cause the repulsive force of the compressed spring 17 to push back the rod 3 and the pipe 12 to their respective forward positions. At this time the pressure in the suction chamber 21 of the body 5 becomes negative and the material 24 in the container 6 is sucked into the suction chamber 21 of the body 5 through the suction hole 18 of the valve seat member 16 (FIG. 4).

When the valve portion 15 is slid forward, the front lip portion 15A is forced to expand radially thereby obtaining a close contact with the inner peripheral wall of the body 5. Further, the forward valve body 19 closes the conduit 12B. Accordingly, air or dirty water does not enter or permeate into the inside of the suction chamber 21 in a negative pressure condition through gaps of sliding portions of the bearing portion 9. The suction results in a negative pressure in the container 6 to cause the movable bottom body 23 to advance for a short distance in close contact with the inside peripheral wall of the container 6.

Figure 5:
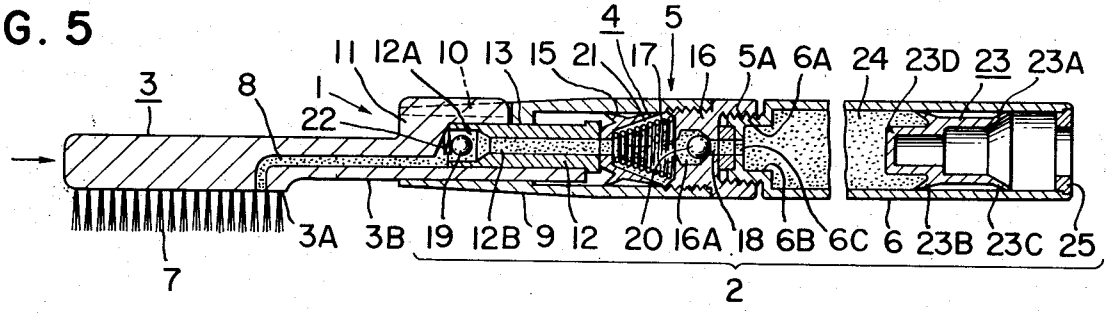
FIG. 5 is a vertical sectional view of the brush of the first embodiment in the condition where the bristle-planted rod is again pushed into to feed a liquid or emulsion material onto a bristle-planting surface after being once returned.
Figure 6:
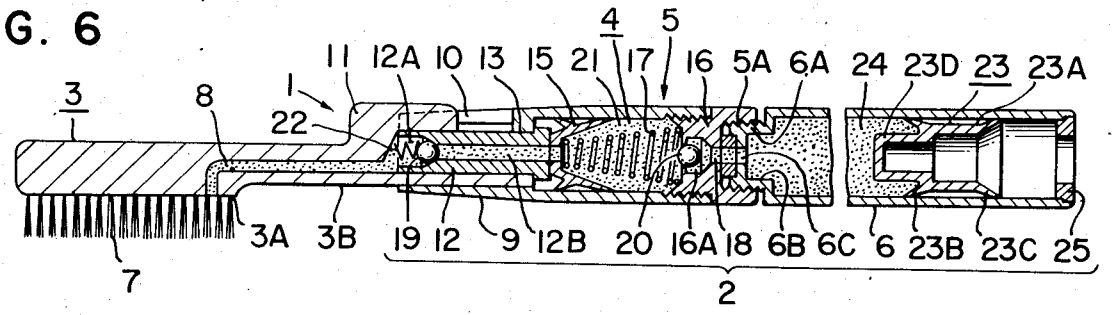
FIG. 6 is a vertical sectional view in the condition following the condition of FIG. 5, where the material is sucked into a suction chamber.

The rod 3 is again pushed rearward as described above. This time the forward valve body 19 opens the conduit 12B of the pipe 12 and the rear valve body 20 closes the suction hole 18 of the valve seat member 16. The material sucked in the suction chamber 21 is fed into the conduit 12B of the pipe 12 and the material passage 8 of the rod 3 (FIG. 5). Thereafter, the rod 3 is freed from the push, and the material 24 in the suction chamber 21 stops flowing forward and the material 24 in the container 6 is sucked from the container 6 into the suction chamber 21 of the body 5 (FIG. 6). Similarly as described above this suction causes the movable bottom body 23 in the container 6 to move forward in response to the sucked amount of the material 24.

When the brush 1 is initially used, this operation is repeated two or three times to fill the body 5, the conduit 12B and the material passage 8 with the material 24. After this, one push of the rod 3 feeds an amount of the material 24 suitable for one operation onto the bristle-planted surface 3A. Thus, the brush 1 is ready for use. Individually if the amount of the material 24 fed onto the surface 3A is not enough, two or more pushes will be given.

When the material 24 in the container 6 has run out, the container 6 is unscrewed from the valve seat member 16, a cap (not shown) screwed on a fresh container 6 at the male thread 6A thereof is disengaged, and the male thread 6A of the fresh container is engaged with the female thread 5A of the body 5. Then immediately the brush 1 can be again used continuously. When the opening of the material passage 8 opening on the bristle-planting surface 3A of the rod 3 may become dry between use of the brush, all of the bristles 7 may be covered with a cap 26 as shown by a phantom line in FIG. 2.

The forward and the rear valve bodies 19 and 20 are not limited to the ball valve but may have any other structure which carries out the same function as the ball valve.

As described above, the brush 1 of this invention comprises the bristle-planted rod 3 having the operational projection 11, and by the rod being pushed toward the main body 5, it can feed a certain amount of the material 24 onto the bristle-planted surface 3A. Advantageously this makes it possible to use the brush with a one touch operation. Besides, since one push of the rod 3 feeds a predetermined amount of the material, its users do not need to pay attention to how much the material should be squeezed for one operation as they do with the conventional operation and wasteful use of excessive material can be avoided. Furthermore, the material 24 is fed by simply pushing the rod 3. Accordingly, when the brush is used as a toothbrush, even infants and children can use the brush 1 easily. Additionally the material container 6 is easily detached from the main body 5 and disposable, and economically the main body 5 of the brush can be used for a long time.

Especially in the brush 1 of this invention, the movable bottom body 23 moves forward in response to a decrease of the material 24 in the container 6 when the rod 3 is pushed rearward to feed the material 24 toward the rod 3. This perfectly prevents air from being sucked from the outside into the material 24 in the container 6. It is desirable in terms of hygiene that the material can be fed in a perfectly sealed condition. Among others, the brush 1 of this invention comprises a small number of components and can be easily fabricated.

Other embodiments of this invention will be explained with reference to FIGS. 7 to 19.

Figure 7:
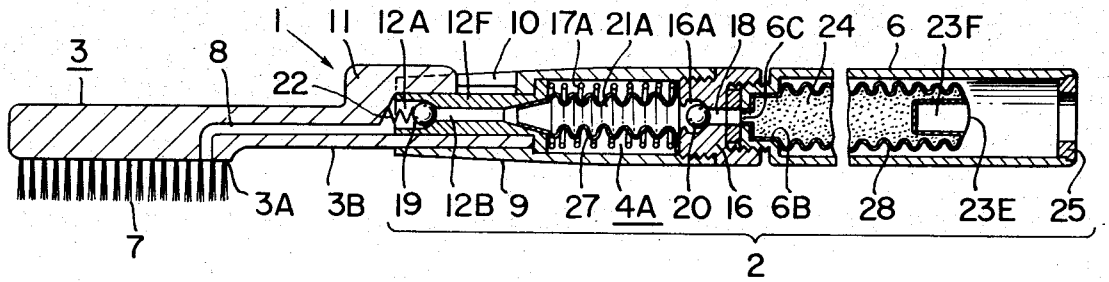
FIG. 7 is a vertical sectional view of a second embodiment of the brush of this invention.

FIG. 7 illustrates a second embodiment of this invention.

In this embodiment, an operational pipe 12F and a valve seat member 16 are connected by a bellows 27 in place of the valve portion 15 of the operational pipe 12. The interior of the bellows 27 provides a suction chamber 21A. A compression spring 17A is disposed around the exterior of the bellows 27. In the container 6 there is provided a bellows 28 in which the material 24 is accommodated. At the bottom of the bellows 28 there is provided a movable bottom body 23E having a projection 23F to be inserted into the small-diameter portion 6B of the mouth of the container.

Except for the structure described above, the second embodiment is structurally identical with that shown in FIG. 2. The second embodiment has the same reference numerals for the same parts as that described in the first embodiment for thesake of brevity these parts are not further described.

A brush of the second embodiment has a pumping mechanism 4A for sucking and feeding the material 24 which is substantially identical in operation with that of the embodiment described in the first embodiment. When the bristle-planted rod 3 is pushed, the compressed spring 17 and the bellows 27 are compressed. At this time the forward valve body 19 opens the conduit 12B of the pipe 12 and the rear valve body 20 closes the hole 18 of the valve seat 16. When the rod 3 is freed from the push, the repulsive force of the compressed spring 17 pushes back the rod 3 with the bellows 27 being expanded. At this time the forward valve body 19 closes the conduit 12B and the rear valve body 20 opens the hole 18, and the material 24 in the container 6 is sucked into the bellows 27. from the bellows 28. Repetition of this operation exudes a suitable amount of the material 24 onto the bristle-planted surface 3A as in the embodiment described in the first embodiment.

Figure 8:
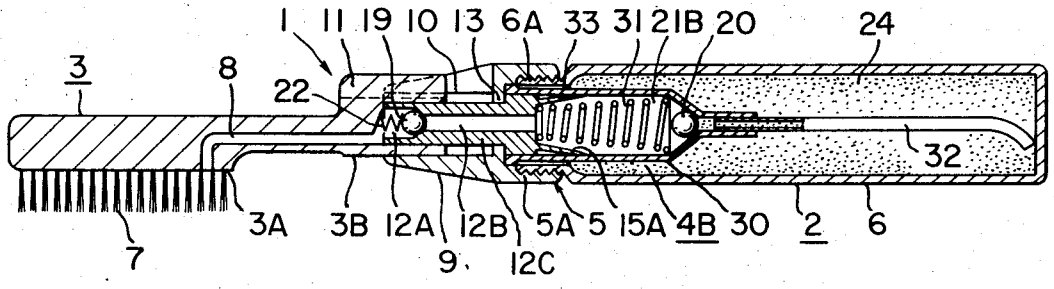
FIG. 8 is a vertical sectional view of a third embodiment of the brush of this invention.

In a third embodiment shown in FIG. 8, there is provided a valve portion 15A which is formed in a bell-shape at the rear end of the operational pipe 12C, in a cylindrical valve case 30 fixedly connected to the main body 5, slidably in close contact therewith. A compression spring 31 is interposed between the rear end of the operational pipe 12C and the bottom of the valve case 30. The compression spring 31 serves to return the bristle-planted rod 3 via the operational pipe 12C to its forward position. The rear valve body 20 in the valve case 30 opens and closes the opening of a suction pipe 32 connected to the bottom of the valve case 30. The forward valve body 19 in the operational pipe 12C opens and closes the forward end of the operational pipe 12C to bring the operational pipe 12C into and out of communication with the material passage 8.

On the side surface of the valve case 30 there are provided air-charge holes 33 of a very small diameter. When the material in the container 6 is sucked into the valve case 30, the pressure in the container 6 becomes negative, making it difficult for the material 24 to be further sucked into the valve case 30. To avoid this, a small amount of air is charged through the holes 33 and a small gap between the two threads 5A and 6A into the container 6.

In the brush of this embodiment, a pumping mechanism 4B operates in almost the same manner as the mechanism 4 described above. The handle 2 being held in one hand, the bristle-planted rod 3 is pushed rearward in a manner that a thumb is put on the operational projection 11 thereof. And the rod 3 is pushed into the main body 5 along the bearing portion 9 thereof, accordingly the operational pipe 12C being pushed into the valve case 30. At this time the forward valve body 19 is opened, the rear valve body 20 being closed. Then, the rod 3 is freed from the push, the urging or repulsive force of the compression spring 31 returns the rod 3 to its forward position. At this time the operational pipe 12C is also returned to its forward position, making the pressure in the valve case 30 negative. Then the material 24 in the container 6 is sucked into the valve case 30 through the suction pipe 32. As described above, when the rod 3 is again pushed rearward, the operational pipe 12C goes into the body 5, the material 24 in the valve case 30 being pushed out through the material passage 8. Then when the rod 3 is freed from the push, the forward valve body 19 is closed, the rear valve body 20 being opened. And again the material 24 is sucked into the valve case 30 from the container 6. After this operation, every one push of the rod 3 feeds a quantity of the material 24 suitable for one operation to the bristle-planted surface 3A. Now the brush of this embodiment is ready for use.

Figure 9:
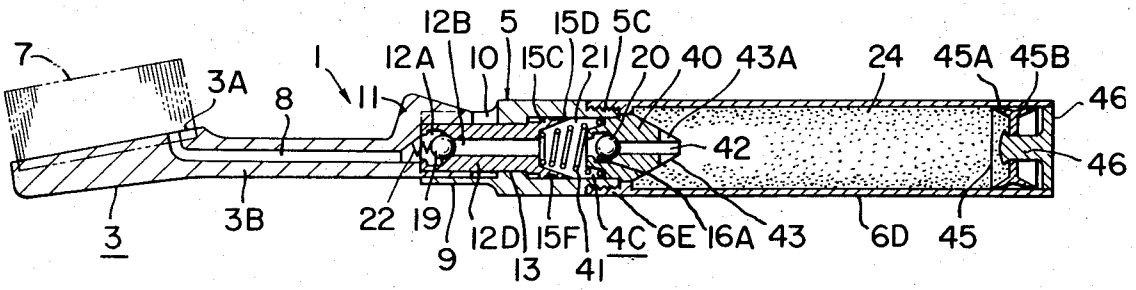
FIG. 9 is a vertical sectional view of a fourth embodiment of the brush of this invention.
Figure 10:
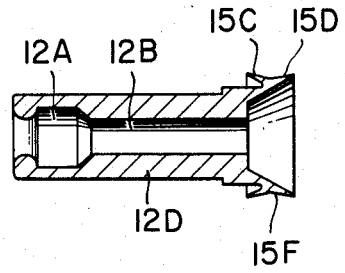
FIG. 10 is a vertical sectional view of an operational pipe of the fourth embodiment.

In the fourth embodiment shown in FIG. 9, a pumping mechanism 4C comprises an operational pipe 12D, the rear end of which is provided with a valve portion 15F slidably in close contact with the inside peripheral surface of the main body 5. The valve portion 15F has, as shown in FIG. 10, a forward slide portion 15C and a rearward slide portion 15D expanded in a bell-shape. A compression spring 41 is interposed between the rear end of the operational pipe 12D and a valve seat member 40 joined by being screwed, for example onto the rear end of the body 5. The compression spring 41 is for returning the rod 3 operational pipe 12D and valve portion 12F to their forward positions.

The forward ball-shaped valve body 19 and the rear ball-shaped valve body 20 are disposed respectively in the larger-diameter portion (valve chamber) 12A at the forward end of the operational pipe 12D and in the larger-diameter portion (valve chamber) 16A at the forward end of a suction hole 42 of the valve seat member 40. The forward valve body 19 in the operational pipe 12D opens and closes the conduit 12B of the operational pipe 12D thereby to bring the material passage 8 into and out of communication therewith. The rear valve body 20 in the valve seat member 40 opens and closes the suction hole 42 of the valve seat member 40. The airtight suction chamber 21 is formed in the body 5. The spring 22 of a weak urging force constantly urges the forward valve body 19 in the direction to close the conduit 12B so that the forward valve body 19 may not open even when the toothbrush 1 is tilted with the rod 3 positioned lower.

Figure 11:
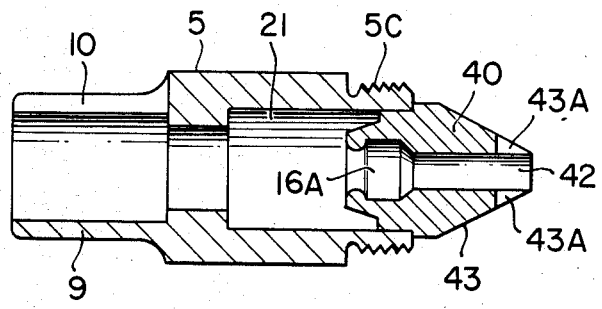
FIG. 11 is a vertical sectional view of an assembly of a handle main body and a valve seat.
Figure 12:
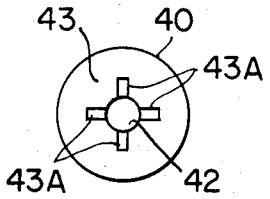
FIG. 12 is a side view of the valve seat.

The valve seat member 40, whose vertical section and end surface are illustrated in FIGS. 11 and 12, respectively, is in the form of a conical projection 43 which is decreasingly tapered toward the tip thereof. The conical projection 43 has, at its rear end, four slits 43A extending radially from a suction hole 42 to form a sharp shape thereat. The conical projection 43 may be made of a different material from that of the forward portion of the valve seat member 40, and the shape of the conical projection 43 is not limited to the one shown in the embodiment.

Figure 13:
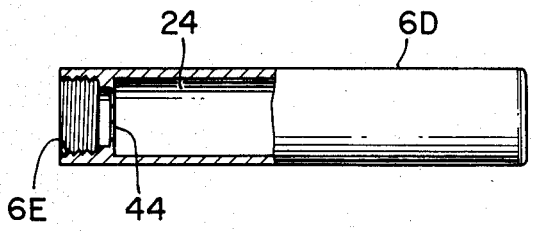
FIG. 13 is a partially broken side view of a material container.
Figure 14:
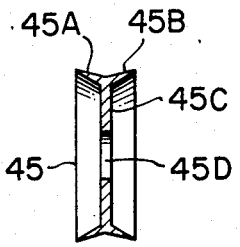
FIG. 14 is an enlarged sectional view of a movable bottom body.

As shown in FIG. 13, the material container 6D has a mouth sealed with a diaphragm 44. As described above, when a female thread 6E in the forward end of the container 6D is engaged with a male thread 5C at the rear end of the main body 5, the conical projection 43 breaks the diaphragm 44 thereby to bring the suction hole 42 of the valve seat member 40 in communication with the interior of the container 6D. When the brush is not in use, a suitable cup is screwed on the female thread 6E.

The bottom of the container 6D is provided with a piston-like movable bottom body 45 which is slidable axially in close contact with the inside peripheral surface of the container 6D. The movable bottom body 45 is made of soft synthetic resin or other material and in the form illustrated in FIGS. 9 and 14. The movable bottom body 45 has slide edges 45A, 45B which are expanded in a bell-shape at the axially forward and the axially rear ends thereof and are reduced in thickness at the tips thereof. The slide edges 45A, 45B contact closely with the inside peripheral surface of the container 6D thereby to retain the airtightness so that the material 24 in liquid or emulsion form in the container 6D may not leak.

The plate 45C of the movable bottom body 45 has a throughbore 45D for filling the material 24 into the container 6D therethrough, provided in the centre thereof. The projected portion 46A of a seal member 46 shown in FIG. 9 is inserted into the throughbore 45D to close it. The seal member 46 also serves as a reinforcement member which prevents the container 6D from being deformed under the influence of exterior forces so that the close contact may not be impaired between the slide edges 45A, 45B between the inside peripheral surface of the container 6D.

In this embodiment, while the container 6 is being screwed onto the main body 5, the sharp point of the projection 43 hits and breaks the diaphragm 44, and when the former is completely screwed on the latter, they are joined in the condition shown in FIG. 9 with the interior of the former being in communication with the valve chamber 16A through the suction hole 42. The pumping mechanism 4C operates in the same manner as that of each of the embodiments described above. The material 24 sealed in the container 6D by the diaphragm 44 does not degrade. While the container 6D is being screwed onto the main body 5, the diaphragm 44 is automatically broken, communicating the interior of the body 5 with the container 6D. Consequently the material does not leak out of the container 6D while both are being connected, and both can be readily connected.

FIGS. 15 to 19 show a sixth embodiment of this invention.

Figure 15:
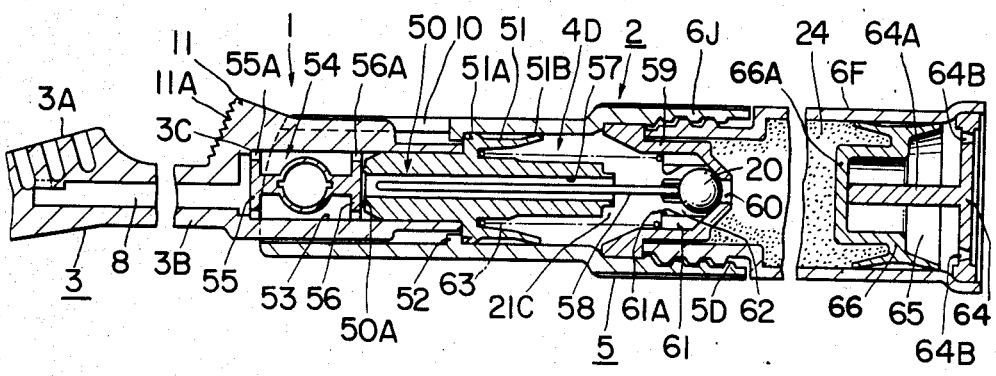
FIG. 15 is a vertical sectional view of a brush of a fifth embodiment of this invention.

In FIG. 15, a brush 1 of the sixth embodiment has a pumping mechanism 4D for sucking and feeding the material 24 contained in a container 6F. The pumping mechanism 4D has an operational pipe 50 which is integrally provided with a valve portion 51 at the outer peripheral surface of the pipe 50. The valve portion 51 has front and rear lip portions 51A and 51B. The front surface of the valve portion 51 is adapted to abut against a projection 52 provided on the inner surface of a main body 5 of a handle 2 when the pipe 50 is in a normal position.

The front part of the pipe 50 is inserted into a hole 53 formed in the rear end 3B of a rod 3. In front of the pipe 50 is accommodated a forward valve body 54 which has a shape shown in FIGS. 18 and 19. The valve body 54 functions in the same manner as the ball-shaped valve body 19 described above and is made of elastic material such as synthetic resin. Further, the valve body 54 has two valve plates 55 and 56 at its front and rear ends, respectively. The valve plate 55 has, in general, a circular shape whose periphery is partially cut to form four paths 55A for passing the materia 24. Another valve plate 56 of the same shape as the plate 55 has four paths 56A. The two valve plates 55 and 56 are connected to each other by a connecting portion 54A which has a loop portion 58 mainly functioning as an elastic member.

The valve body 54 is accommodated in the hole 53 in a state wherein the peripheral portion of the front valve plate 55 abuts against a step 3C formed on the inner surface of the hole 53.

The front face of the operational pipe 50 is provided with an annular projection 50A which engages with the rear valve plate 56. The pipe 50 has a conduit 57 extending in its longitudinal direction in order to feed the material 24 from a suction chamber 21C to the rod 3. In the conduit 57 is freely accommodated an operational bar 58 for controlling the movement of the forward valve body 54 and the rear valve body 20. The rear valve body 20 is received in a cup-shaped valve seat member 59 whose bottom has a suction hole 60. On the inner wall of the valve seat member 59 are provided a plurality of ribs 61. The ribs 61 are disposed at a predetermined distance in the circumferential direction of the valve seat member 59. The ribs 61 form a space 62 for accommodating the rear valve body 20 and each rib 61 has a projection 61A, at its front end, for preventing the valve body 20 from coming out of the space 62.

The rear half portion of the operational pipe 50 is extended into the suction chamber 21C. A compression coil spring 63 is provided between the front faces of the ribs 61 and the inner side of the bell-shaped valve portion 51 in a state wherein the rear half portion of the pipe 50 is inserted into the coil spring 63.

The above operational bar 58 is slender enough not to prevent the material 24 from passing through the conduit 57 of the pipe 50 and is slightly shorter than the distance between the two valve bodies 54 and 20 in a state where the valve body 54 closes the conduit 57 and the valve body 20 closes the suction hole 60 as shown in FIG. 15.

The rear end of the main body 5 is detachably engaged with the front end of the container 6F through a female thread 5D and a male thread 6J.

The container 6F has a movable bottom body 66 which is slidable axially in close contact with the inner peripheral surface of the container 6F and a bottom plate 64 inserted into the opened rear end of the container 6F. The bottom plate 64 has, at its center, a projected bar 64A which is projected into a cylindrical portion 66A of the bottom body 66 to restrict the rearward movement of the bottom body 66. The bottom plate 64 is provided with a plurality of air passages 64B for preventing air pressure in a rear space 65 defined by the bottom body 63 and the bottom plate 64 from becoming negative when the bottom plate 66 is moved forward during the use of the brush 1.

Furthermore, there is provided a slip prevention surface 11A on an operational projection 11. The surface 11A is rugged in order to prevent a thumb of a user's hand from slipping thereon.

Figure 16:
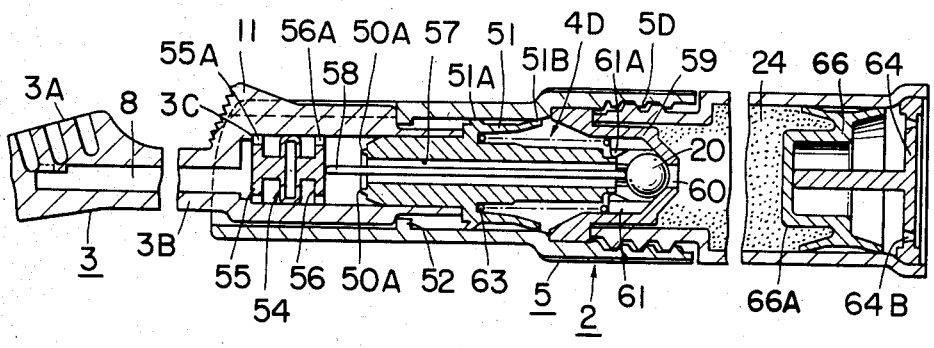
FIG. 16 is a vertical sectional view in the condition where a bristle-planted rod is pushed into a handle main body.

When the rod 3 is pushed into the handle 2 as shown in FIG. 16, the operational pipe 50 is moved rearward and the front end of the operational bar 58 abuts against the valve plate 56 to cause the valve body 54 to be compressed axially or deformed so that the conduit 57 is opened while its rear end abuts against the rear valve body 20 thereby to close tightly the suction hole 60. FIG. 16 shows an initial stage wherein the rod 3 is pushed when there is no material 24 in the conduit 57 and the suction chamber 21C. However, if the material 24 exists in the conduit 57 and the suction chamber 21C as shown in FIG. 4, the material will be fed into the passage 8 of the rod 3 through the paths 55A and 56A of the valve body 54.

Figure 17:
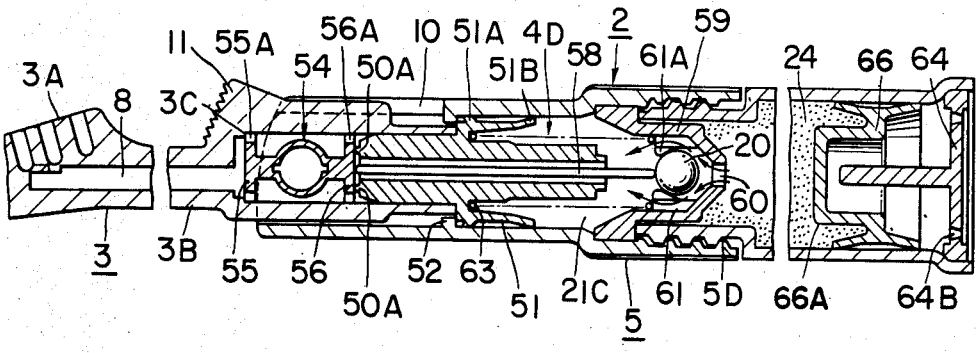
FIG. 17 is a vertical sectional view of the brush of the fifth embodiment in the condition where the bristle-planted rod is returned after being pushed thereinto initially.
Figure 18:
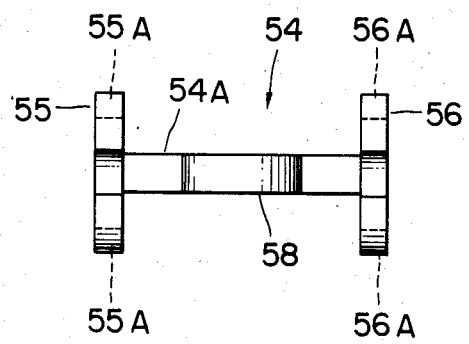
FIG. 18 is a plan view of a valve provided in the fifth embodiment.
Figure 19:
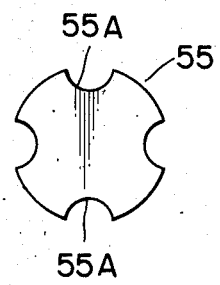
FIGS. 19(A) and (B) are elevational views of two valve plates provided at the opposite ends of the valve body, respectively.
Figure 19:
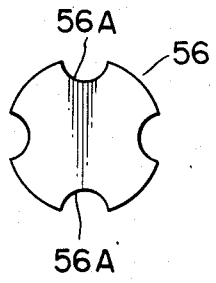

When the rod 3 is freed from the push, the operational pipe 50 is returned to the initial position by the repulsive force of the coil spring 63 and the front face of the pipe 50 abuts against the valve plate 56 again to close the front opening of the conduit 57 (FIG. 17). At the same time, the pressure in the suction chamber 21C becomes negative whereby the rear valve body 20 is pulled toward the inside of the suction chamber 21C so as to open the suction hole 60. Accordingly, an amount of the material 24 in the container 6F is sucked into the suction chamber 21C. This suction results in a negative pressure in the container 6F to cause the movable bottom body 66 to be advanced for a short distance. An amount of the material 24 can be fed onto the bristle-planted surface 3A of the rod 3 by repeating this operation two or three times as described in FIGS. 2 to 6.

The characteristic features of the sixth embodiment reside in that the operational bar 58 is provided between the forward valve body 54 and the rear valve body 20 to control the open-close movement of the two valve bodies 54 and 20 and that the forward valve body 54 is not a ball but an elastic valve member.

Accordingly, the operational bar 58 can ensure a reliable alternative open-close movement of the two valve bodies as shown in FIGS. 16 and 17 and the provision of a special spring corresponding to the spring 22 for the forward valve body 19 shown in FIGS. 2 to 9 can be omitted.

In the above embodiments, on the head of the rod 3 are planted a great number of bristles for applying the material 24. However, instead of the bristles, a piece of sponge, a piece of rubber or a member having a convex-concave surface for applying the material 24 thereon may be attached to the head of the rod 3.

What is claimed is:

1. A brush for applying liquid or emulsion material comprising:

(a) a handle having a container for containing material in liquid or emulsion form and a main body, a rear end of which is connected detachably to a mouth of the container, the container having a movable bottom body which moves along an inner wall of the container as the material is sucked through the mouth of the container;

(b) a rod provided, at its head, with brush means for application of the material and slidable inserted, at its root portion, into a forward bearing portion of the main body in such a manner that rotation of the rod can be avoided and the rod can be reciprocated axially, and the rod having a material feeding passage extending from its root portion to the brush means at the head of the rod;

(c) a pumping mechanism disposed within the main body for sucking the material from the container and feeding the sucked material to the head of the rod, and operated in accordance with reciprocal axial movements of the rod, the pumping mechanism including a suction chamber disposed within the main body and sealing means within the suction chamber for keeping the suction chamber airtight in order to prevent foreign matters from being sucked thereinto and for effecting a vacuum in the suction chamber to suck the material from the container into the suction chamber, the suction chamber being in fluid communication with the material feeding passage in the rod and the mouth of the container, the sealing means being connected to the rod for reciprocal axial movement therewith for pumping material to the bursh means and sucking material out of the container;

(d) elastic means dipsosed within the suction chamber for biasing the rod in an axial position with respect to the main body of the handle;

(e) a rotation preventing means including an operational projection formed on a peripheral surface of the root portion of the rod and functioning as a pushing member on which a finger is put when the rod is pushed axially; and (f) a slit means, axially provided in a bearing portion of the main body, for slidably receiving the operational projection.

2. A brush according to claim 1, wherein the pumping mechanism comprises an operational pipe received slidably in the main body so as to be moved in accordance with axial movements of the rod, the sealing means comprising a valve portion integrally formed at the outer circumferential surface of the operational pipe so as to be in airtight contact with the inner surface of the main body, the elastic means comprising a conpression spring for urging the operational pipe forward, a forward and a rear valve body in the forward and rear positions of the main body, respectively, in a state wherein the operational pipe is located between the two valve bodies so as to form the suction chamber therebetween, the forward valve body bringing the material feeding passage into and out of communication with the suction chamber while the rear valve body brings a suction hole open to the inside of the container into and out of communication with the suction chamber, and an operational bar provided between the two valve bodies in such a manner that the bar passes through a conduit, formed in the operational pipe, for feeding the material from the suction chamber to the head of the rod, so as to control the open-close movement of the two valve bodies.

3. A brush according to claim 2, wherein the forward valve body is of an elastic material whereby the forward valve body is expanded and contracted in accordance with the movement of the operational pipe.

4. A brush according to claim 1, wherein the pumping mechanism comprises, an operational pipe received slidably in a forward portion of the main body and connected, at its forward end, to the root portion of the rod, the elastic means comprising a compression spring for urging the operational pipe forward, a forward and a rear valve body each provided in the main body so as to form the suction chamber therebetween, the forward valve body bringing the material feeding passage into and out of communication with the suction chamber while the rear valve body brings a suction hole extending between the mouth of the container and the suction chamber into and out of communication with the suction chamber and the sealing means comprising a valve portion formed at the rear end of the operational pipe and sliding on the inner peripheral surface of the suction chamber in an airtight contact therewith.

5. A brush according to claim 1, wherein the pumping mechanism comprises an operational pipe received slidably in a forward portion of the main body and connected, at its forward end, to the root portion of the rod, the elastic means comprising a compression spring for urging the operational pipe forward, a forward and rear valve body provided in the main body so as to form the suction chamber therebetween, the forward valve body bringing the material feeding passage into and out of communication with the suction chamber while the rear valve body brings a suction hole extending between the mouth of the container and the suction chamber into and out of communication with the suction chamber and a bellows provided in the main body for forming the suction chamber therein.

6. A brush according to claim 1, wherein the pumping mechanism comprises an operational pipe received slidably in the main body and connected, at its forward end, to the root portion of the rod, a cylindrical valve case fixedly connected to the main body, slidably accommodating the sealing means which comprises a sealing portion of the operational pipe, and forming the suction chamber therein, a suction pipe connected to a rear end of the valve case for sucking the material into the suction chamber, the elastic means comprising a compression spring for urging the operational pipe forward, a forward and a rear valve body between which the suction chamber is provided, the forward valve body bringing the material feeding passage into and out of communication with the suction chamber while the rear valve body brings the suction pipe into and out of communication with the suction chamber.

7. A brush according to claim 4, wherein the mouth of the container is closed with a diaphragm, the rear end of the main body being closed with a valve seat member for holding the rear valve body, the valve seat member being provided with a relatively sharp projection extending rearward for breaking the diaphragm when the container is connected to the main body of the handle.

8. A brush according to claim 5, wherein the container has a bellows therein for containing the material.

9. A brush for applying liquid or emulsion material comprising:

(a) a handle having a container for containing the material in liquid or emulsion form and a main body, a rear end of which is connected detachably to a mouth of the container, the container having a movable bottom body which moves along an inner wall of the container as the material is sucked through the mouth of the container;

(b) a bristle planted rod provided, at its head, with a great number of bristles, and slidably inserted, at its root portion, into a forward bearing poriton of the main body in such a manner that rotation of the rod can be avoided and the rod can be reciprocated axially, and the rod having a material feeding passage extending therein from its root portion to a bristle planted surface of the head of the rod;

(c) a pumping mechanism disposed within the main body for sucking the material from the container and feeding the sucked material to the bristle planted surface, and operated in accordance with reciprocal axial movements of the rod, the pumping mechanism including a suction chamber disposed within the main body, the suction chamber being in fluid communication with the mouth of the container, and an operational pipe slidably mounted in the main body provided with sealing means for keeping the suction chamber airtight in order to prevent foreign matters from being sucked thereinto and for effecting a vacuum in the suction chamber to suck the material from the container into the suction chamber, the operational pipe providing fluid communication between the material feeding passage in the rod and the suction chamber for pumping material to the bristle planted surface of the rod in response to reciprocal axial movement of the rod;

(d) elastic means disposed within the suction chamber for biasing the rod in an axial position with respect to the main body of the handle;

(e) a rotation preventing means including an operational projection formed on a peripheral surface of the root portion of the rod and functioning as a pushing member on which a finger is put when the rod is pushed axially; and (f) a slit means, axially provided in a bearing portion of the main body, for slidably receiving the operational projection.

10. A brush according to claim 9, wherein the sealing means is formed in a bell-shape and provided at the rear end of the operational pipe.

11. A brush according to claim 9, wherein the sealing means is integrally formed at the outer circumferential surface of the operational pipe so as to be in airtight contact with the inner surface of the main body.

12. A brush according to claim 9, wherein the sealing means includes forward and rearward slide portions for slidingly engaging with the inner surface of the main body.

13. A brush according to claim 9, wherein the pumping mechanism further comprises a forward and a rear valve body in the forward and rear positions of the main body, respectively, in a state wherein the operational pipe is located between the two valve bodies so as to form the suction chamber therebetween, the forward valve body bringing the material feeding passage into and out of communication with the suction chamber while the rear valve body brings a suction hole open to the inside of the container into and out of communication with the suction chamber, and an operational bar provided between the two valve bodies in such a manner that the bar passes through a conduit, formed in the operational pipe, for feeding the material from the suction chamber to the head of the rod, so as to control the open-close movement of the two valve bodies.

14. A brush according to claim 13, wherein the forward valve body is of an elastic material whereby the forward valve body is expanded and contracted in accordance with the movement of the operational pipe.

15. A brush according to claim 9, wherein the mouth of the container is closed with a diaphragm, the rear end of the main body being closed with a valve seat member for holding the rear valve body, the valve seat member being provided with a relatively sharp projection extending rearward for breaking the diaphragm when the container is connected to the main body of the handle.

* * * * *